US012454403B2

(12) United States Patent
Brunet Gagne et al.

(10) Patent No.: US 12,454,403 B2
(45) Date of Patent: Oct. 28, 2025

(54) PACKAGE FOR ABRASIVE WHEELS

(71) Applicant: WALTER SURFACE TECHNOLOGIES INC., Pointe-Claire (CA)

(72) Inventors: Marc Brunet Gagne, Pointe-Claire (CA); Mykolai Dutkewych, Pointe-Claire (CA); James Watkins, Raynham, MA (US)

(73) Assignee: WALTER SURFACE TECHNOLOGIES INC., Pointe-Claire (CA)

( * ) Notice: Subject to any disclaimer, the term of this patent is extended or adjusted under 35 U.S.C. 154(b) by 6 days.

(21) Appl. No.: 18/562,931

(22) PCT Filed: Jun. 20, 2022

(86) PCT No.: PCT/CA2022/050990
§ 371 (c)(1),
(2) Date: Nov. 21, 2023

(87) PCT Pub. No.: WO2022/266752
PCT Pub. Date: Dec. 29, 2022

(65) Prior Publication Data

US 2024/0262608 A1 Aug. 8, 2024

Related U.S. Application Data

(60) Provisional application No. 63/213,862, filed on Jun. 23, 2021.

(51) Int. Cl.
*B65D 85/02* (2006.01)
*B65D 21/02* (2006.01)
(Continued)

(52) U.S. Cl.
CPC ..... *B65D 85/02* (2013.01); *B65D 21/022* (2013.01); *B65D 25/10* (2013.01);
(Continued)

(58) Field of Classification Search
CPC ..... B65D 85/02; B65D 21/022; B65D 25/10; B65D 43/0202; B65D 85/62; B65D 2543/00092
(Continued)

(56) References Cited

U.S. PATENT DOCUMENTS 3,084,791 A * 4/1963 Edwin ..... B65D 25/00 220/592.2
3,393,798 A 7/1968 Beers
(Continued)

OTHER PUBLICATIONS

International Search Report and Written Opinion dated Aug. 25, 2022, issued in application No. PCT/CA2022/050990.

*Primary Examiner* — Orlando E Aviles
*Assistant Examiner* — Jenine Pagan
(74) *Attorney, Agent, or Firm* — McClure, Qualey & Rodack, LLP

(57) ABSTRACT

A package for abrasive wheels is provided. The package comprises a base providing an inner space between a side surface, an open end having a diameter $D_{open}$ and a closing plane end having a diameter $D_{closed}$, the inner space being adapted to contain stacked abrasive wheels having a diameter $D_{wheel}$, the side surface having a projecting portion having a diameter $D_{proj}$, that projects from the closing plane end; and a cover configured to couple to the base at the open end so as to close the inner space, the base and the cover insulating the abrasive wheels against atmospheric agents when coupled, the cover comprising a projection shaped to define an annular plane portion having an inner diameter $D_{in}$ and an outer diameter $D_{out}$.

16 Claims, 13 Drawing Sheets

(51) Int. Cl.
*B65D 25/10* (2006.01)
*B65D 43/02* (2006.01)
*B65D 85/62* (2006.01)

(52) U.S. Cl.
CPC ..... *B65D 43/0202* (2013.01); *B65D 85/62* (2013.01); *B65D 2543/00092* (2013.01); *B65D 2543/00527* (2013.01); *B65D 2543/00537* (2013.01)

(58) Field of Classification Search
USPC ..... 206/303, 304, 503, 509, 511
See application file for complete search history.

(56) References Cited

U.S. PATENT DOCUMENTS

| | | | | |
|---|---|---|---|---|
| 4,742,932 | A | 5/1988 | Pedragosa | |
| 4,801,015 | A * | 1/1989 | Lubock | A61F 2/0095 206/525 |
| 5,823,342 | A * | 10/1998 | Caudillo | A61F 2/0095 623/2.11 |
| 7,775,361 | B2 | 8/2010 | Ficai | |
| 8,857,610 | B1 * | 10/2014 | Gruber | B65D 43/0222 206/403 |
| 10,514,064 | B2 * | 12/2019 | White | B25B 27/00 |
| 2008/0156812 | A1 * | 7/2008 | Chai | B65D 43/0202 220/574 |
| 2014/0069884 | A1 | 3/2014 | Paredes | |

* cited by examiner

PACKAGE FOR ABRASIVE WHEELS

FIELD

The technical field generally relates to a package, and more specifically relates to a package for abrasive wheels.

BACKGROUND

Abrasive wheels are composed of an abrasive compound that can be used for various abrasive cutting and abrasive machining operations. Abrasive wheels are typically sold in packages that protect the abrasive wheels from atmospheric agents. However, several challenges remain in the configuration of the packages, for example in the way the empty packages are transported and/or in the way the packages can be stacked together when filled with abrasive wheels.

SUMMARY

A package for abrasive wheels is provided. The package comprises: a base providing an inner space between a side surface, an open end having a diameter $D_{open}$ and a closing plane end having a diameter $D_{closed}$, the inner space being adapted to contain stacked abrasive wheels having a diameter $D_{wheel}$, the side surface (11*a*) having a projecting portion (11*d*) having a diameter $D_{proj}$, that projects from the closing plane end; and a cover configured to couple to the base at the open end so as to close the inner space, the base and the cover insulating the abrasive wheels against atmospheric agents when coupled, the cover comprising a projection shaped to define an annular plane portion having an inner diameter $D_{in}$ and an outer diameter $D_{out}$, wherein $D_{wheel} \leq D_{in} < D_{proj} \leq D_{closed} < D_{open} \leq D_{out}$.

In some embodiments, $D_{in}=D_{wheel}$. In some embodiments, $D_{proj}=D_{closed}$. In some embodiments, $D_{proj}<D_{closed}$. In some embodiments, $D_{open}=D_{out}$. In some embodiments, $D_{open}<D_{out}$.

In some embodiments, the side surface comprises a base portion extending from the closing plane end.

In some embodiments, the side surface comprises a base portion, an annular base belt portion and an edge portion, wherein: the base portion extends from the closing plane end to a first end of the annular base belt portion, and the edge portion extends from a second end of the annular base belt portion to the open end; and the annular base belt portion protrudes away from the side surface thereby defining a shoulder between an outer surface of the annular base belt portion and the edge portion.

In some embodiments, the base portion is a frustoconical base portion having a first diameter $D_{closed}$ at the closing plane end of the base and a second diameter $D_{belt}$ at the first end of the annular base belt portion, wherein $D_{closed}<D_{belt}$.

In some embodiments, the frustoconical base portion has a half-cone angle $\alpha$ between about 0.5° and about 4°.

In some embodiments, the frustoconical base portion has a half-cone angle $\alpha$ between about 1° and about 3°.

In some embodiments, the edge portion is a cylindrical or frustoconical edge portion having a first diameter $D_{belt}$ at the second end of the annular base belt portion and a second diameter $D_{open}$ at the open end of the base, wherein $D_{belt} \geq D_{open}$.

In some embodiments, the edge portion is cylindrical and $D_{belt}=D_{open}$.

In some embodiments, the edge portion is frustoconical and $D_{belt}>D_{open}$.

In some embodiments, the base portion is a frustoconical base portion having a first diameter $D_{closed}$ at the closing plane end of the base and a second diameter $D_{belt}$ at the first end of the annular base belt portion, wherein $D_{closed}<D_{belt}$, the edge portion is a frustoconical edge portion having a first diameter $D_{belt}$ at the second end of the annular base belt portion and a second diameter $D_{open}$ at the open end of the base, wherein $D_{belt}>D_{open}$; and wherein the frustoconical base portion has a half-cone angle $\alpha$ and the frustoconical edge portion has a half-cone angle $\beta$, wherein $\alpha \geq -\beta$.

In some embodiments, the cover has a annular cover belt portion protruding away from the side surface of the cover and shaped to correspond to the annular base belt portion and fit onto the shoulder when the package is closed.

In some embodiments, the annular base belt portion and the annular cover belt portion form together a cylindrical belt when the package is closed.

In some embodiments, the projection comprises a plurality of recesses distributed along the annular plane portion.

DETAILED DESCRIPTION

Figure 1:
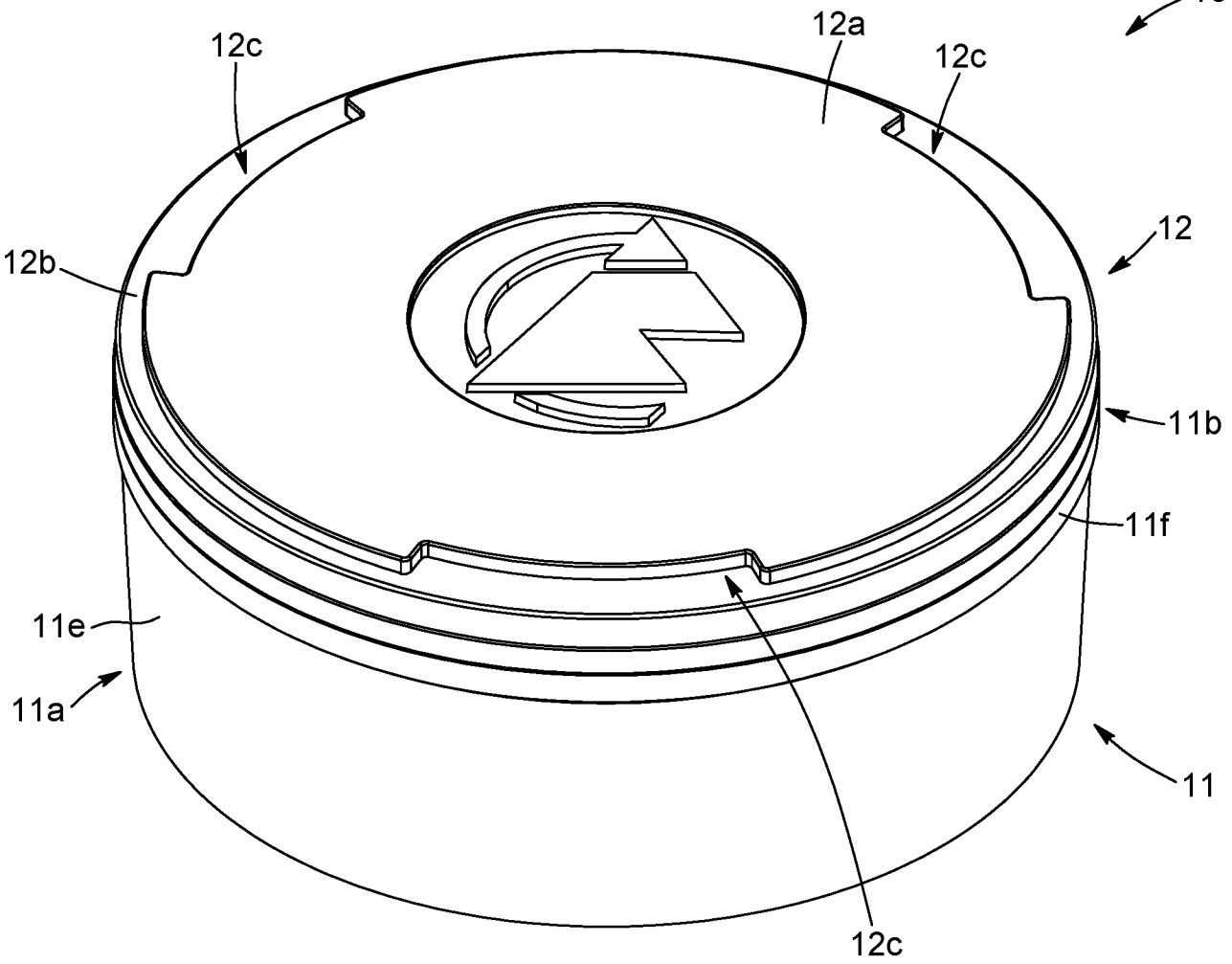
FIG. 1 is a perspective view of a package for abrasive wheels, according to an embodiment.
Figure 2B:
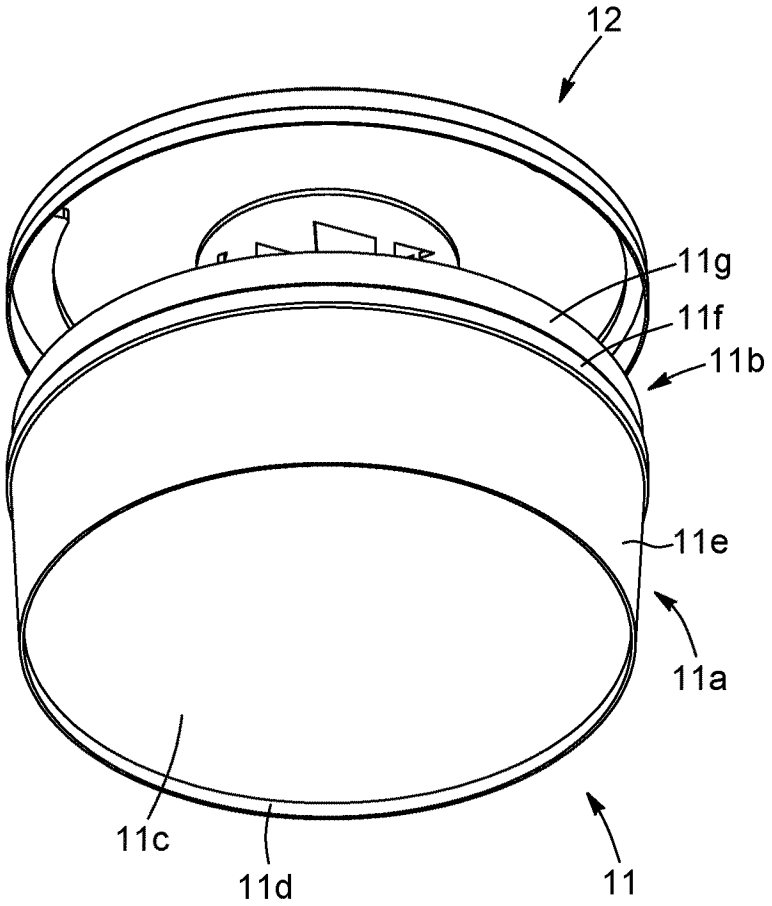
FIG. 2B is another perspective view the package for abrasive wheels of FIG. 1, with the cover detached from the base.
Figure 2A:
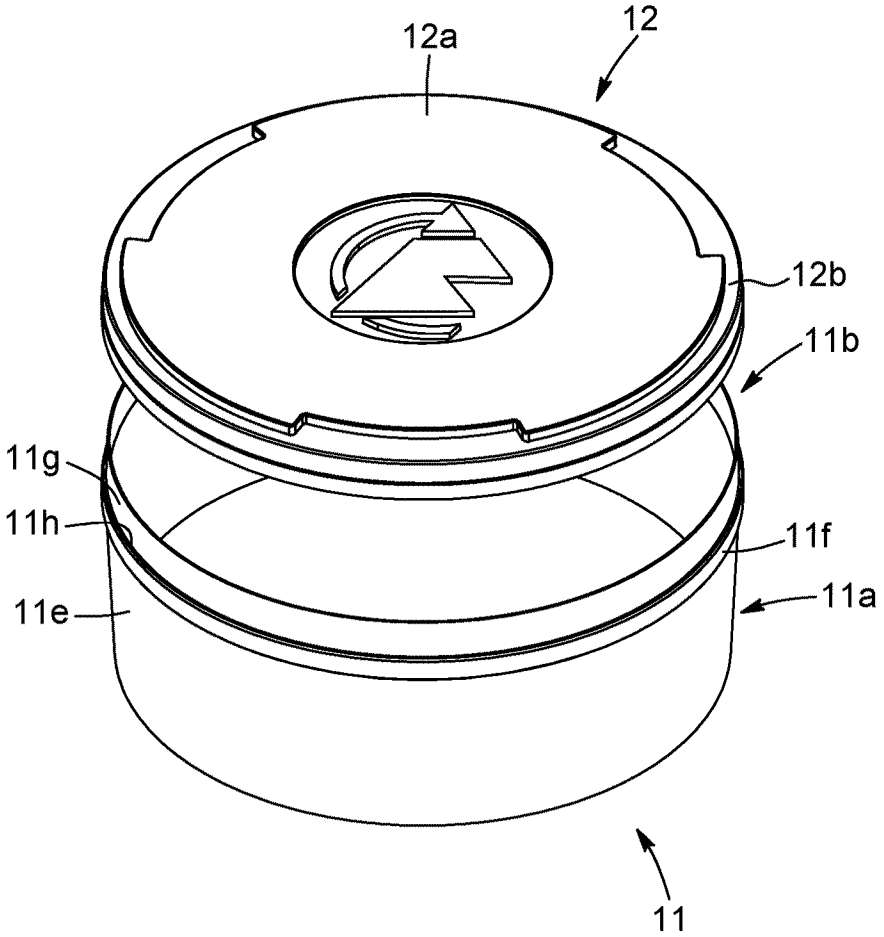
FIG. 2A is a perspective view of the package for abrasive wheels of FIG. 1, with the cover detached from the base.
Figure 3B:
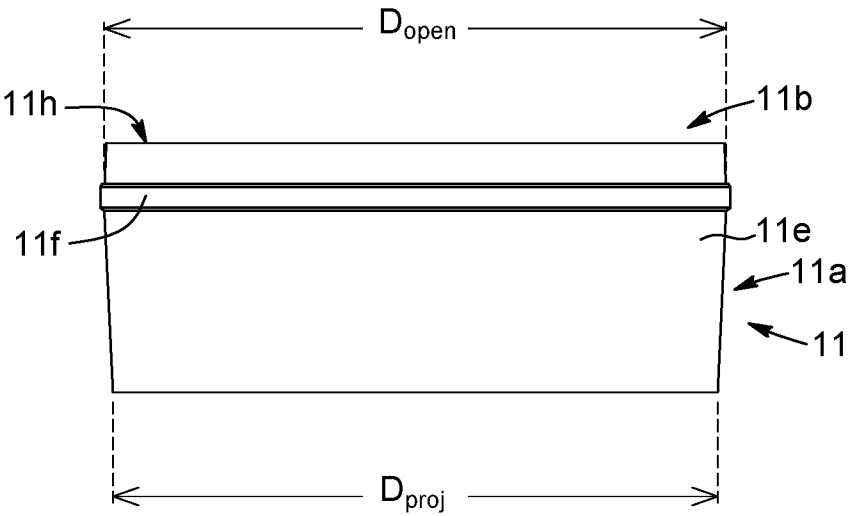
FIG. 3B is a side elevation view of the base of the package of FIG. 1.
Figure 3A:
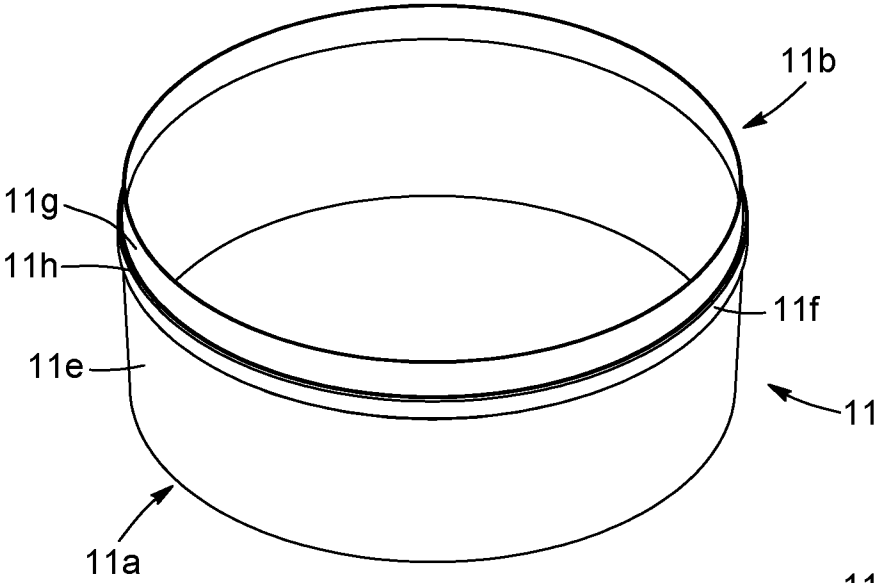
FIG. 3A is a perspective view of the base of the package of FIG. 1.
Figure 3D:
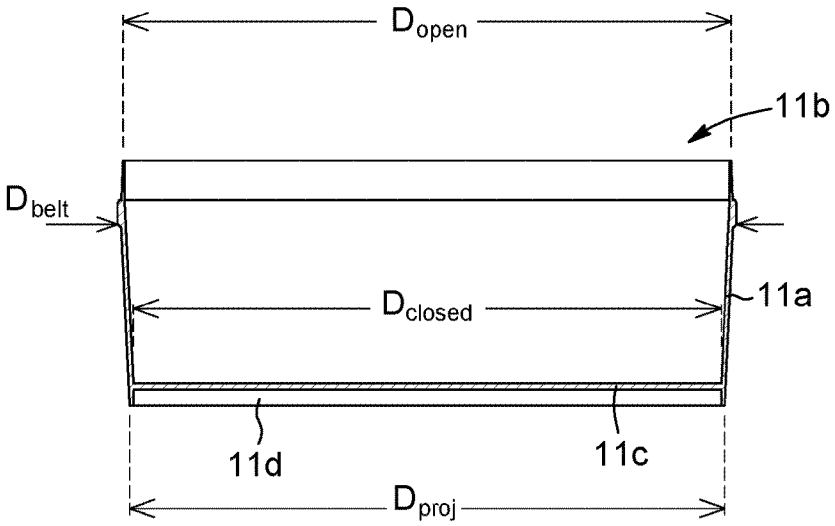
FIG. 3D is a cross-sectional view of the base of FIG. 3C, taken along section 3D-3D.
Figure 3C:
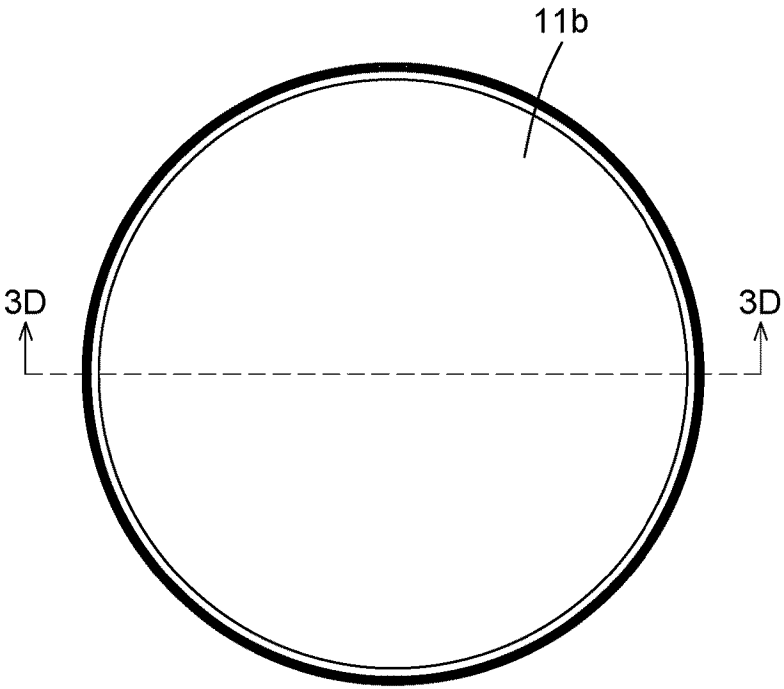
FIG. 3C is a top view of the base of the package of FIG. 1.
Figure 4B:
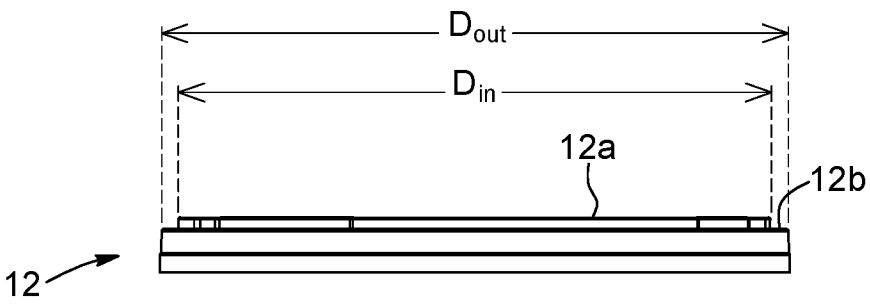
FIG. 4B is a side elevation view of the cover of the package of FIG. 1.
Figure 4A:
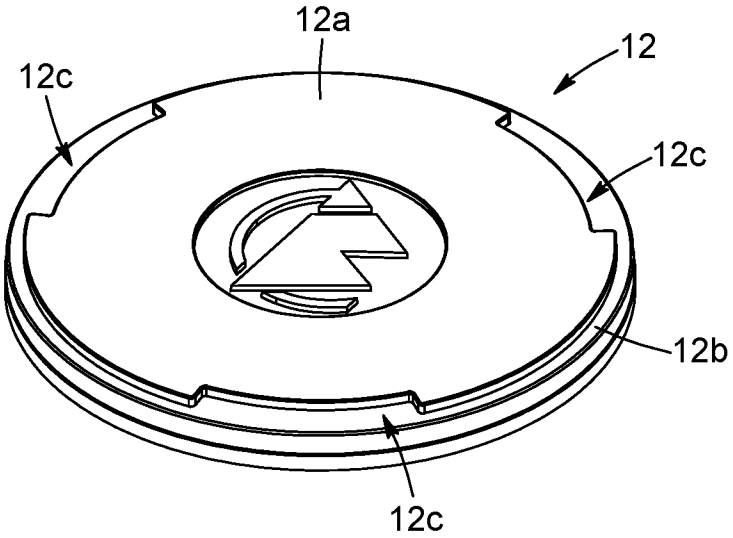
FIG. 4A is a perspective view of the cover of the package of FIG. 1.
Figure 4C:
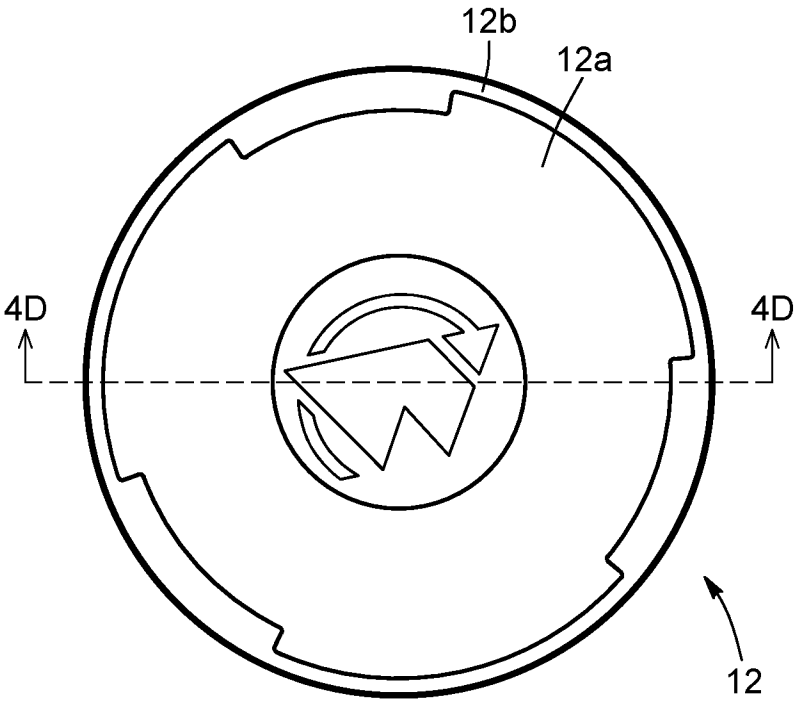
FIG. 4C is a top view of the base of the package of FIG. 1.
Figure 4D:
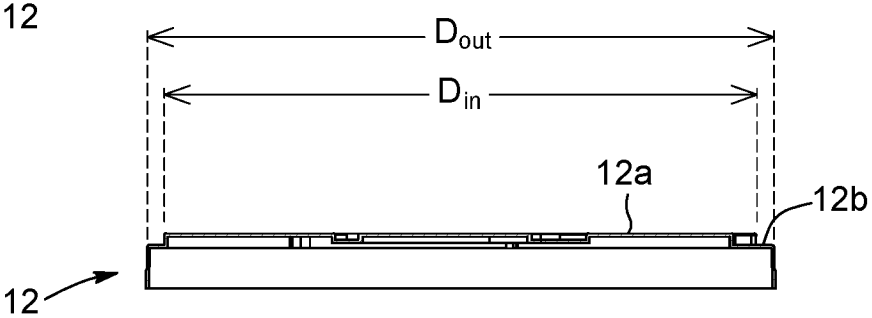
FIG. 4D is a cross-sectional view of the cover of FIG. 4C, taken along section 4D-4D.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale and that the emphasis is instead being placed upon clearly illustrating the elements and structures of the present embodiments.

It will be appreciated that positional descriptions such as "top", "bottom", "above", "under", "below", "left", "right", "front", "rear", "parallel", "perpendicular", "transverse", "inner", "outer", "internal", "external", and the like should, unless otherwise indicated, be taken in the context of the figures and should not be considered limiting.

In the present description, a package for abrasive wheels is provided. It is understood that an abrasive wheel (also referred to as a grinding wheel) is a wheel composed of an abrasive compound that can be used for various abrasive cutting and abrasive machining operations. Such wheels are typically used in grinding machines. Various types of abrasive wheels exist, such as straight wheels, cylinder wheels or wheel rings, tapered wheels, straight cup wheels, dish cup wheels, saucer wheels, diamond wheels and cut off wheels. It is typically advantageous to insulate abrasive wheels from atmospheric agents, for example by enclosing the abrasive wheels in a package (e.g., a plastic package).

Now referring to FIGS. 1, 2A-B, 3A-D and 4A-D, in some embodiments, a package 10 for abrasive wheels is provided. The package includes a base 11 and a cover 12 configured to couple to the base 11. The base 11 provides an inner space between a side surface 11*a*, an open end 11*b* having a diameter $D_{open}$ and a closing plane end 11*c* having a diameter $D_{closed}$. The inner space of the base 11 is adapted to contain stacked abrasive wheels having a diameter $D_{wheel}$. The side surface 11*a* has a projecting portion 11*d* that projects from the closing plane end 11*c* and that has a diameter $D_{proj}$. The cover 12 is configured to couple to the base 11 at the open end 11*b* to close the inner space. The base 11 and the cover 12 insulate the abrasive wheels from atmospheric agents when the base 11 and the cover 12 are coupled. The cover 12 includes a projection 12*a* that is shaped to define an annular plane portion 12*b*. The annular plane portion 12*b* has an inner diameter $D_{in}$ and an outer diameter $D_{out}$. As will be described herein, some of the elements of the base 11 and cover 12 can be sized and shaped to complement each other. For example, the shape of the base 11 and/or cover 12 and/or the various diameters can be selected to better accommodate the abrasive wheels within the package 10, to promote a more convenient stacking of multiple packages 10 on top of one another and/or to promote a more convenient stacking of multiple bases 11 and/or covers 12 on top of one another.

The base 11 and the cover 12 can be made of any type of material that insulates the abrasive wheels from atmospheric agents. Preferably, the base 11 and the cover 12 are made of plastic material.

In some embodiments, the diameters described herein have the following relative relationships: $D_{wheel} \leq D_{in} < D_{proj} \leq D_{closed} < D_{open} \leq D_{out}$.

The annular plane portion 12*b* corresponds to an annular plane space at the periphery of the cover 12. The inner diameter of the annular plane portion 12*b* is defined by joining the outer most portions of projection 12*a* together by a hypothetical circular joining line, and the outer diameter of the annular plane portion 12*b* is the outermost diameter of the cover 12. The inner diameter of the annular plane portion 12*b* is preferably selected to be equal to or greater than the diameter of the abrasive wheels to be stored in the package 10, that is $D_{wheel} \leq D_{in}$. Similarly, the outer diameter of the annular plane portion 12*b* is preferably greater than the diameter of the abrasive wheels and the inner diameter, that is $D_{wheel} \leq D_{in} < D_{out}$. In some embodiments, the inner diameter of the annular plane portion 12*b* is substantially equal to the diameter of the abrasive wheels, that is $D_{in} = D_{wheel}$. In other embodiments, the inner diameter of the annular plane portion 12*b* is strictly greater than the diameter of the abrasive wheels, that is $D_{wheel} < D_{in}$.

In the embodiment shown in the Figures, the projection 12*a* is a pseudo-circular projection wherein a circle of diameter $D_{in}$ is provided with three (3) recesses 12*c*. It should however be understood that the shape and number of recesses 12*c* can vary, or that the recesses 12*c* can be absent.

In some embodiments, the base 11 is provided with a side surface 11*a*, an open end 11*b* having a diameter $D_{open}$ and a closing plane end 11*c* having a diameter $D_{closed}$. The side surface 11*a* is also provided with a projecting portion 11*d* having a diameter $D_{proj}$ and that projects downwards from the closing plane end 11*c*. The diameters are preferably selected such that $D_{proj} \leq D_{closed} < D_{open}$. In some embodiments, $D_{proj}$ is substantially equal to $D_{closed}$, that is $D_{proj} = D_{closed}$. In other embodiments, $D_{proj}$ is strictly smaller than $D_{closed}$, that is $D_{proj} < D_{closed}$.

In some embodiments, the diameter $D_{proj}$ of the projecting portion 11*d* is selected such that $D_{in} < D_{proj} \leq D_{out}$. Preferably, the diameter $D_{proj}$ of the projecting portion 11*d* is further selected such that when the projecting portion 11*d* is resting on the annular plane portion 12*b* of a cover 12 and abutted against a side surface of the projection 12*a* of the cover 12 on one side, the entirety of the projecting portion 11*d* stays within the annular plane portion 12*b*, without extending outside the surface defined by the annular plane portion 12*b*.

In the embodiments shown, the projecting portion 11*d* is circular and continuous, and is provided at the periphery and under the closing plane end 11*c*. However, it should be understood that the projecting portion 11*d* can be discontinuous or provided with recesses or notches or have other shapes.

In some embodiments, the projection 12*a* has a height that is equal to or smaller than the height of the projecting portion 11*d*, such that the projecting portion 11*d* is allowed to rest upon the surface defined by the annular plane portion 12*b* when the base 11 is stacked upon a cover 12.

The projecting portion 11*d* of a first package 10 can be provided on top of the cover 12 of a second package 10, such that the projecting portion 11*d* of the first package rests on the surface defined by the annular plane portion 12*b* of the second package. Preferably, the diameter of the projecting portion 11*d* is slightly larger than the inner diameter of the annular plane portion 12*b* such that the first package fits onto the surface defined by the annular plane portion 12*b* and allows stacking of the second package onto the first package.

In some embodiments, the diameter of the open end 11*b* is equal to or smaller than the outer diameter of the annular plane portion 12*b*, that is $D_{open} \leq D_{out}$. In some scenarios, $D_{open}=D_{out}$. In other scenarios, $D_{open}<D_{out}$.

In some embodiments, the side surface 11*a* includes a base portion 11*e*, an annular base belt portion 11*f* and an edge portion 11*g*. The base portion 11*e* extends from the closing plane end 11*c* to a first end of the annular base belt portion 11*f*, and the edge portion 11*g* extends from a second end of the annular base belt portion 11*f* to the open end 11*b*. In some embodiments, the annular belt portion 11*f* protrudes away from the side surface and defines a shoulder 11*h* between an outer surface of the annular base belt portion 11*f* and the edge portion 11*g*.

In some embodiments, and as shown in the Figures, the base portion 11*e* has a frustoconical shape having a first diameter $D_{closed}$ at the closing plane end of the base 11, and a second diameter $D_{belt}$ at the first end of the annular base belt portion 11*f*. It should be understood that the second diameter $D_{belt}$ is measured on the base portion 11*e*, and at the edge between the base portion 11*e* and the base belt portion 11*f*. In other words, the second diameter $D_{belt}$ does not represent the protrusion of the annular base belt portion 11*f*, but rather the largest diameter of the base portion 11*e*. Preferably, the first diameter $D_{closed}$ is smaller than the second diameter $D_{belt}$, that is $D_{closed}<D_{belt}$. In other words, the frustoconical base portion 11*e* is angled such that the smaller diameter is closest to the closing plane end 11*c* and the largest diameter is closest to the annular belt portion 11*f*.

In some embodiments, the edge portion 11*g* has a cylindrical or frustoconical shape. The edge portion 11*g* has a first diameter $D_{belt}$ at the second end of the annular base belt portion 11*f* and a second diameter $D_{open}$ at the open end 11*b* of the base 11. Preferably, the first diameter $D_{belt}$ is equal to or larger than the second diameter $D_{open}$, that is $D_{belt}>D_{open}$. More specifically, when the edge portion 11*g* has a cylindrical shape, $D_{belt}=D_{open}$. Similarly, when the edge portion 11*g* has a frustoconical shape, $D_{belt}>D_{open}$.

Figure 5:
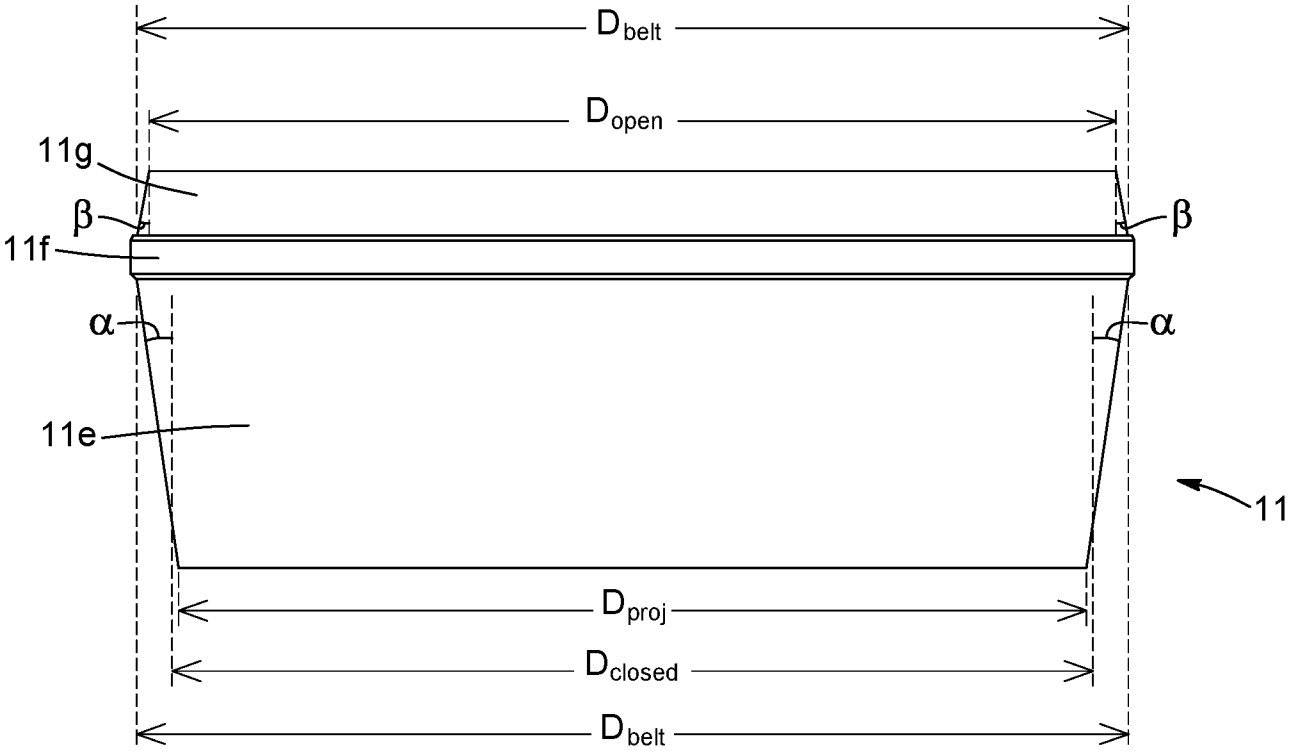
FIG. 5 is a schematic representation of a cross-sectional view of the base, according to an embodiment, where half-cone angles $\alpha$ and $\beta$ are illustrated as more pronounced than in the embodiment of FIG. 1.
Figure 6:
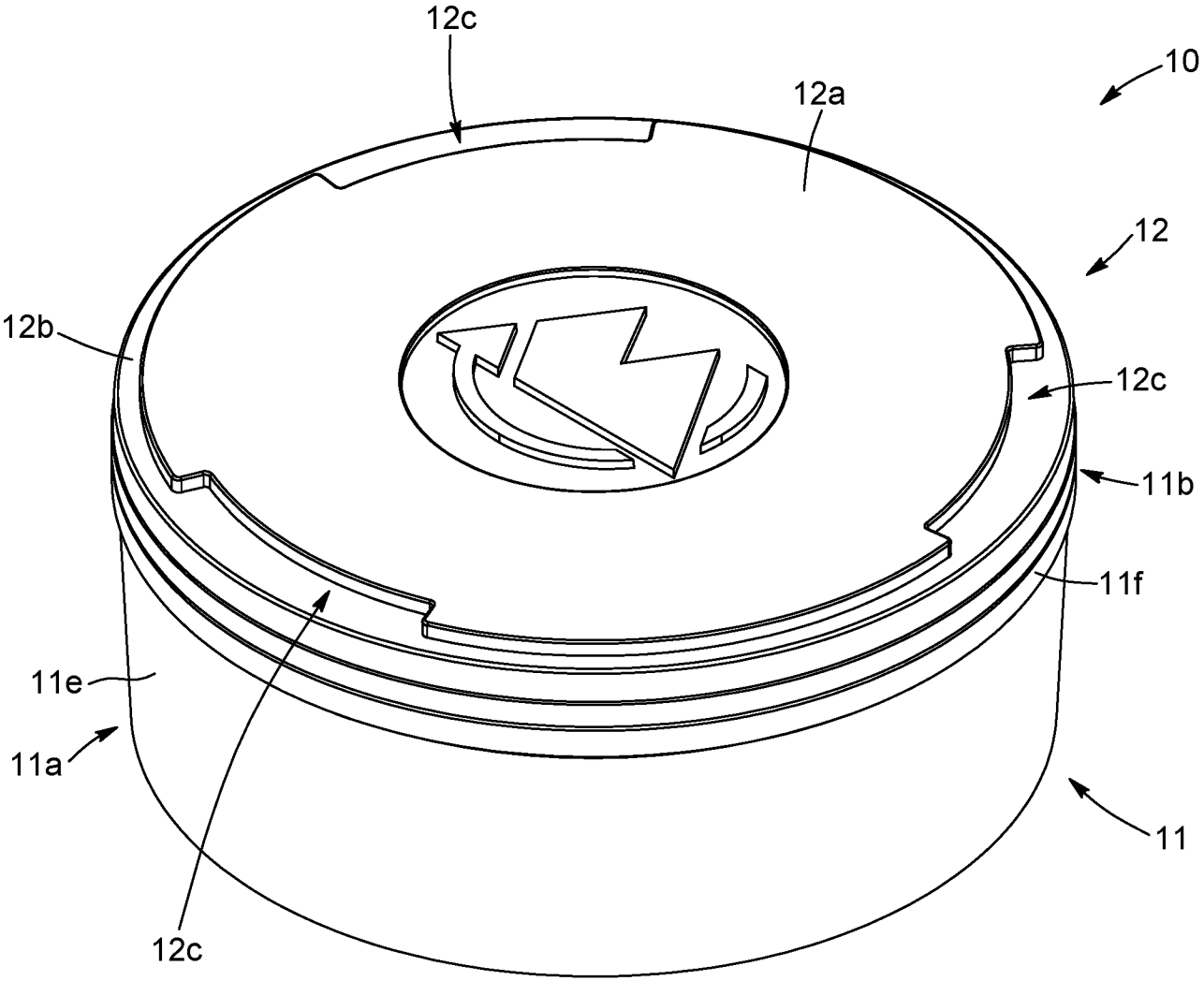
FIG. 6 is a perspective view of a package for abrasive wheels, according to another embodiment.
Figure 7B:
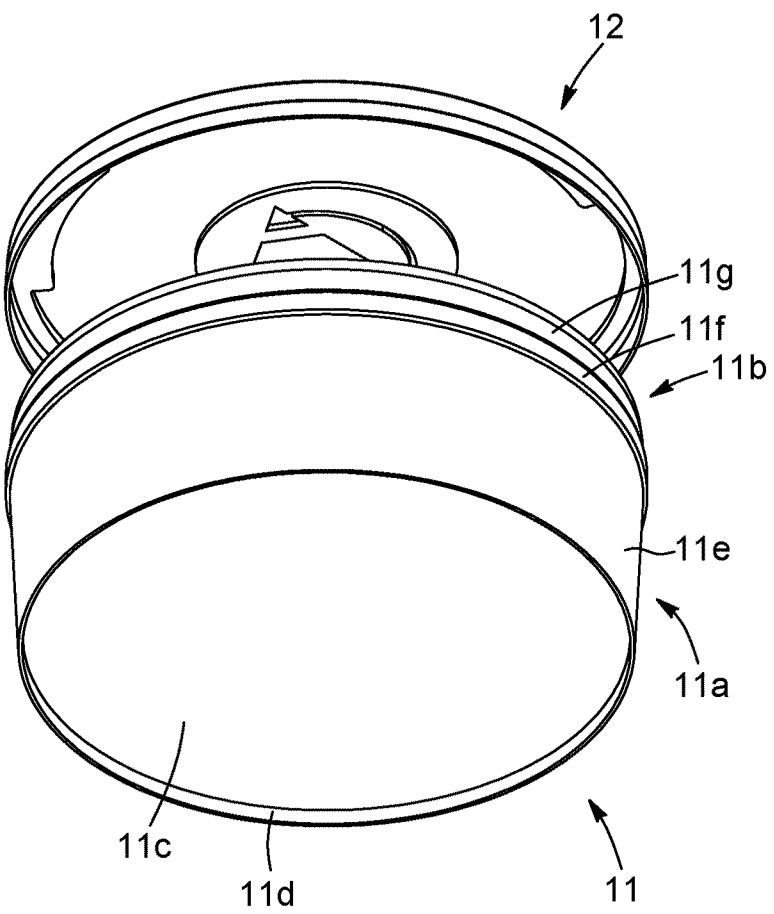
FIG. 7B is another perspective view the package for abrasive wheels of FIG. 6, with the cover detached from the base.
Figure 7A:
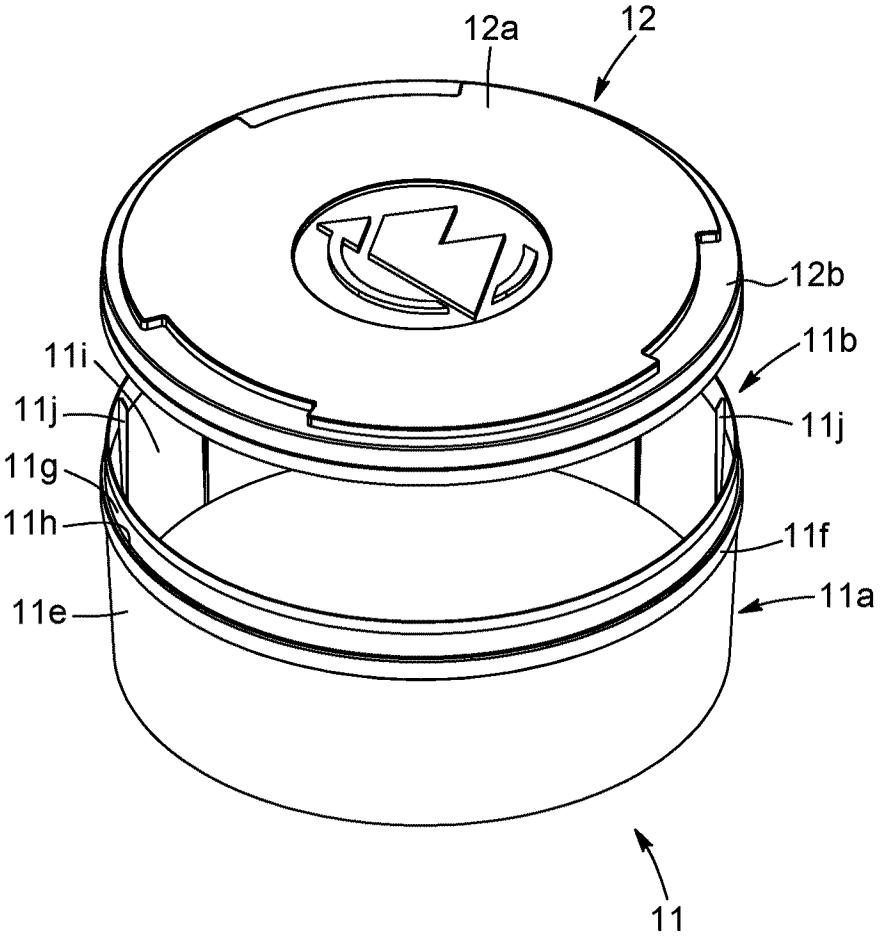
FIG. 7A is a perspective view of the package for abrasive wheels of FIG. 6, with the cover detached from the base.
Figure 8B:
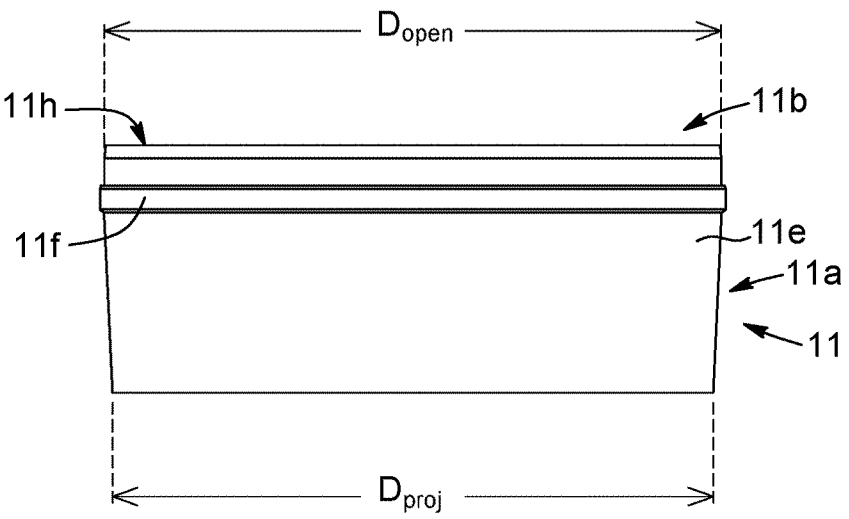
FIG. 8B is a side elevation view of the base of the package of FIG. 6.
Figure 8A:
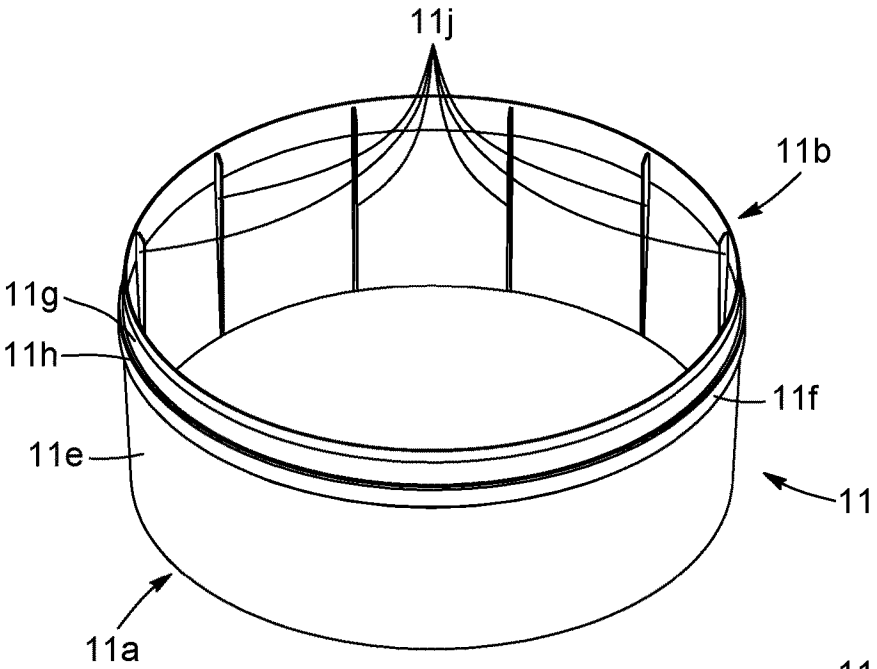
FIG. 8A is a perspective view of the base of the package of FIG. 6.
Figure 8D:
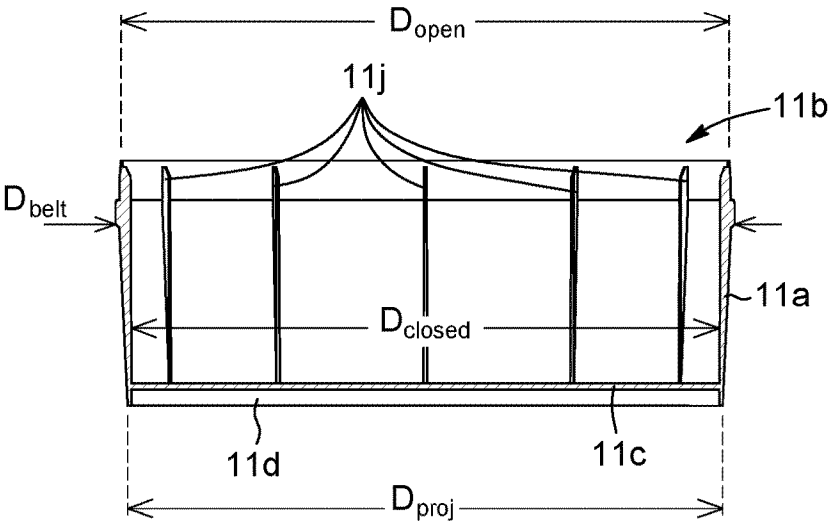
FIG. 8D is a cross-sectional view of the base of FIG. 8C, taken along section 8D-8D.
Figure 8C:
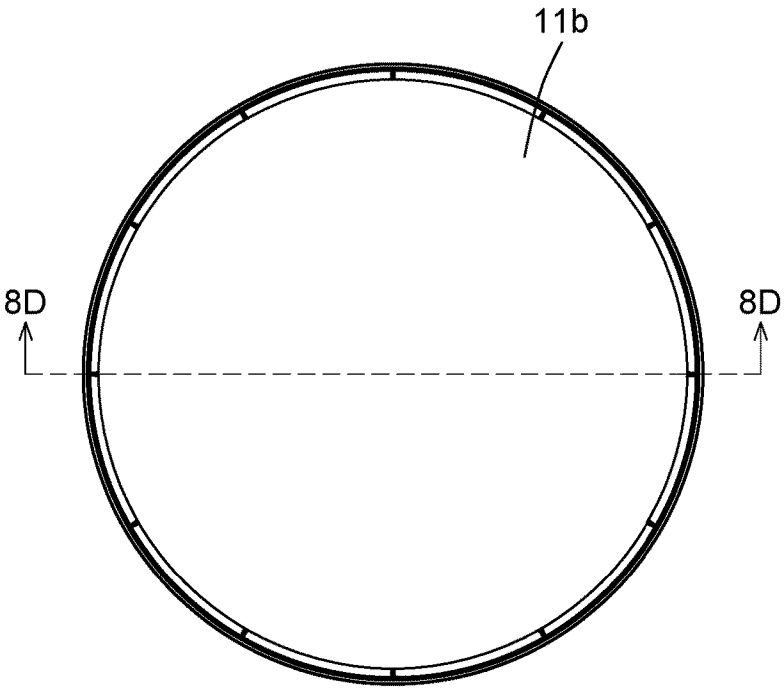
FIG. 8C is a top view of the base of the package of FIG. 6.
Figure 9B:
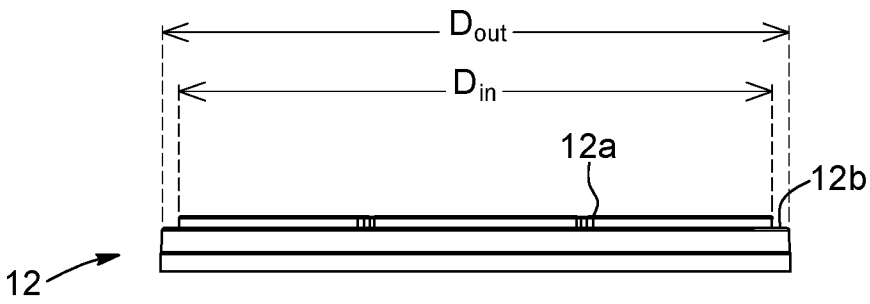
FIG. 9B is a side elevation view of the cover of the package of FIG. 6.
Figure 9A:
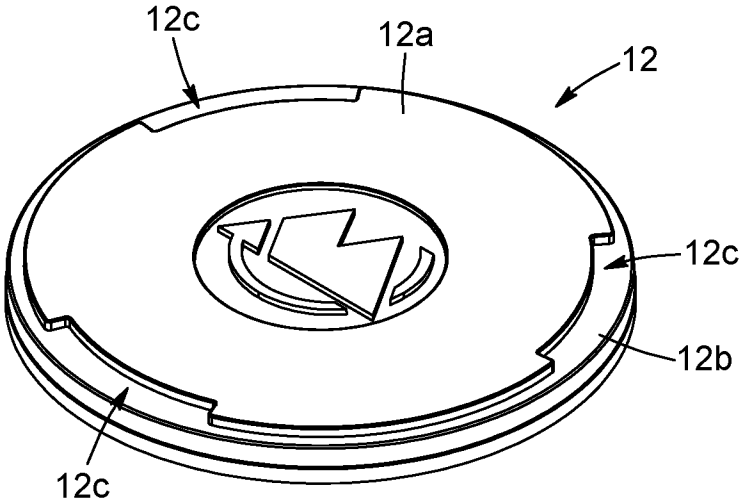
FIG. 9A is a perspective view of the cover of the package of FIG. 6.
Figure 9D:
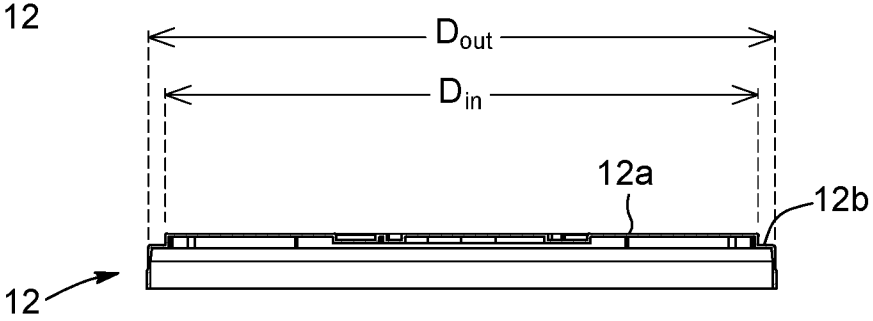
FIG. 9D is a cross-sectional view of the cover of FIG. 9C, taken along section 9D-9D.
Figure 9C:
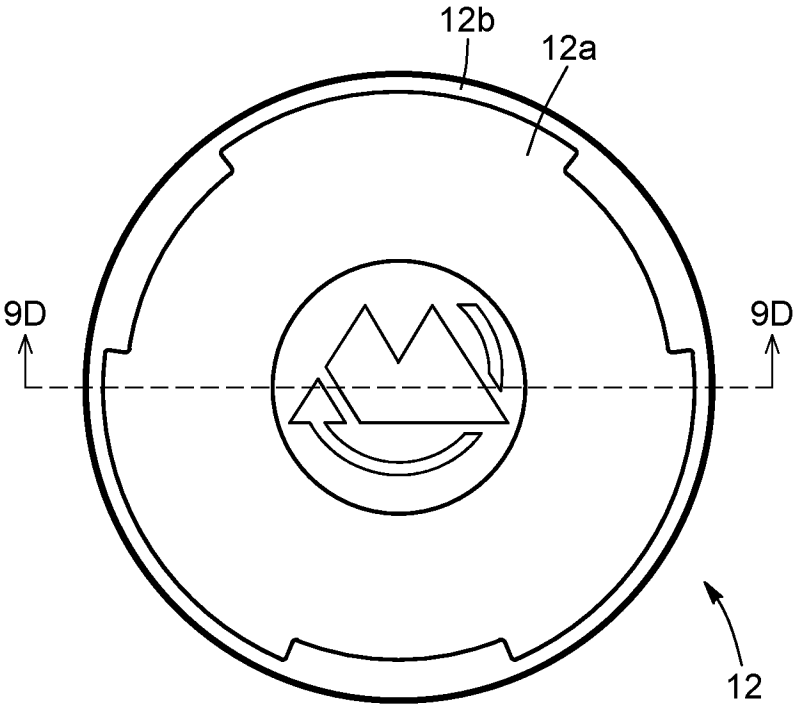
FIG. 9C is a top view of the base of the package of FIG. 6.

Now referring to FIG. 5, an embodiment of the base 11 is shown where more pronounced half-cone angles $\alpha$ and $\beta$ of the base portion 11*e* and the edge portion 11*g*, respectively, are shown, for illustrative purposes. In the embodiment shown at FIG. 5 as well as in the embodiment shown at FIGS. 1, 2A-B, 3A-D and 4A-D, the half-cone angle $\alpha$ of the base portion 11*e* and the half-cone angle $\beta$ of the edge portion 11*g* are of opposite directions. In other words, the base portion 11*e* is angled outwardly from the bottom up of the base 11 while the edge portion 11*g* is angled inwardly from the bottom up of the base 11. Preferably, the half-cone angles $\alpha$ and $\beta$ are selected such that $\alpha \geq -\beta$, or more preferably such that $\alpha>-\beta$.

In some embodiments, the half-cone angle $\alpha$ is selected between about 0.5° and about 4° or between about 0.5° and about 4.0°, and preferably between about 1° and about 3° or between about 1.0° and about 3.0°. By selecting a base 11 having a frustoconical base portion 11*e* with a half-cone angle $\alpha$ between about 0.5° and about 4°, several bases 11 can be nested into one another when no abrasive wheels are stored therein. This can for example allow saving space when shipping packages 10 to a location where the bases 11 will get filled with abrasive wheels. In some embodiments, the half-cone angle $\beta$ is selected between about −0.2° and about −1.1°, or between about −0.25° and about −1.0°. In some embodiments, $\alpha>-\beta$, wherein the half-cone angle $\alpha$ is between about 1.0° and about 3.0°, and the half-cone angle $\beta$ is between about −0.25° and about −1.0°.

Now referring back to FIGS. 1, 2A-B, 3A-D and 4A-D, the cover 12 can also have an annular cover belt portion 12*f* that protrudes away from the side surface of the cover 12. The annular cover belt portion 12*f* is preferably shaped to correspond to the annular base belt portion 11*f* and can fit onto the shoulder 11*h* when the package 10 is closed. In some embodiments, the annular base belt portion 11*f* and the annular cover belt portion 12*f* form together a cylindrical belt when the package 10 is closed.

It was notably observed that selecting the various diameters such that $D_{wheel} \leq D_{in} < D_{proj} \leq D_{closed} < D_{open} \leq D_{out}$, and selecting a frustoconical base portion with a half-cone angle $\alpha$ between about 0.5° and about 4°, preferably between about 1.0° and about 3.0°, provided notable advantages to the package 10: when empty, multiple empty bases 11 can be nested into one another and take less space during transportation; and when filled with stacked abrasive wheels, multiple packages can be conveniently stacked onto one another, with the projecting portion 11*d* of a first package resting on the annular plane portion 12*b* of a second package and the projection 12*a* acting as an abutting member to prevent the first package from slipping on the surface of the cover 12 of the second package.

Referring now to FIGS. 6, 7A-B, 8A-D and 9A-D, in some embodiments, the internal surface 11*i* of the base 11 is provided with a plurality of ribs 11*j* that extend between the closing end plane 11*c* and the open end 11*b*. The ribs 11*j* can have a thickness that increases along their length and towards the closing end plane 11*c*, such that an imaginary circle parallel to the closing end plane and passing by the edge of each one of the ribs 11*j* has a constant diameter along the length of the ribs 11*j*. Preferably, the constant diameter along the length of the ribs 11*j* is equal to the diameter $D_{closed}$ of the closing end plane 12*c*. In some embodiments, the ribs 11*j* are provided at an equal distance from one another and all around the internal surface 11*i* of the base 11. When the ribs 11*j* are provided, the lateral movement of the abrasive discs is more limited than when the ribs 11*j* are absent.

Several alternative embodiments and examples have been described and illustrated herein. The embodiments described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. The present examples and embodiments, therefore, are to be considered in all respects as illustrative and not restrictive. Accordingly, while specific embodiments have been illustrated and described, numerous modifications come to mind without significantly departing from the scope defined in the appended claims.

The invention claimed is:

1. A package for abrasive wheels, the package comprising:

a base providing an inner space between a side surface, an open end having a diameter $D_{open}$ and a closing plane end having a diameter $D_{closed}$, the inner space being adapted to contain stacked abrasive wheels having a diameter $D_{wheel}$, the side surface having a projecting portion having a diameter $D_{proj}$, that projects from the closing plane end; and a cover configured to couple to the base at the open end so as to close the inner space, the base and the cover insulating the abrasive wheels against atmospheric agents when coupled, the cover comprising a projection shaped to define an annular plane portion having an inner diameter $D_{in}$ and an outer diameter $D_{out}$, wherein $D_{wheel} \leq D_{in} < D_{proj} \leq D_{closed} < D_{open} \leq D_{out}$, and wherein the side surface comprises a base portion, an annular base belt portion and an edge portion, wherein:

the base portion extends from the closing plane end to a first end of the annular base belt portion, and the edge portion extends from a second end of the annular base belt portion to the open end; and the annular base belt portion protrudes away from the side surface thereby defining a shoulder between an outer surface of the annular base belt portion and the edge portion, wherein the base portion is a frustoconical base portion having a first diameter corresponding to $D_{closed}$ at the closing plane end of the base and a second diameter $D_{belt}$ at the first end of the annular base belt portion, wherein $D_{closed}<D_{belt}$; and wherein the edge portion is a cylindrical or frustoconical edge portion having a first diameter corresponding to $D_{belt}$ at the second end of the annular base belt portion and a second diameter corresponding to $D_{open}$ at the open end of the base, wherein $D_{belt}>D_{open}$.

2. The package of claim 1, wherein $D_{in}=D_{wheel}$.

3. The package of claim 1, wherein $D_{proj}=D_{closed}$.

4. The package of claim 1, wherein $D_{proj}<D_{closed}$.

5. The package of claim 1, wherein $D_{open}=D_{out}$.

6. The package of claim 1, wherein $D_{open}<D_{out}$.

7. The package of claim 1, wherein the frustoconical base portion has a half-cone angle $\alpha$ between about 0.5° and about 4°.

8. The package of claim 7, wherein the frustoconical base portion has the half-cone angle $\alpha$ between about 1° and about 3°.

9. The package of claim 1, wherein the edge portion is cylindrical and $D_{belt}=D_{open}$.

10. The package of claim 1, wherein the edge portion is frustoconical and $D_{belt}>D_{open}$.

11. The package of claim 1, wherein:

$D_{closed}<D_{belt}$;

the edge portion is a frustoconical edge portion having the first diameter $D_{belt}$ at the second end of the annular base belt portion and the second diameter $D_{open}$ at the open end of the base, wherein $D_{belt}>D_{open}$; and wherein the frustoconical base portion has a half-cone angle $\alpha$ and the frustoconical edge portion has a half-cone angle $\beta$, wherein $\alpha \geq -\beta$.

12. The package of claim 11, wherein the half-cone angle $\alpha$ is between about 1.0° and about 3.0°, and the half-cone angle $\beta$ is between about −0.25° and about −1.0°.

13. The package of claim 1, wherein the cover has an annular cover belt portion protruding away from the side surface of the cover and shaped to correspond to the annular base belt portion and fit onto the shoulder when the package is closed.

14. The package of claim 13, wherein the annular base belt portion and the annular cover belt portion form together a cylindrical belt when the package is closed.

15. The package of claim 1, wherein the projection comprises a plurality of recesses distributed along the annular plane portion.

16. The package of claim 1, wherein an internal surface of the base is provided with a plurality of ribs that extend between the closing end plane and the open end, wherein the ribs have a thickness that increases along their length and towards the closing end plane, such that an imaginary circle parallel to the closing end plane and passing by the edge of each one of the ribs has a constant diameter along the length of the ribs.

* * * * *